US006371191B1

(12) United States Patent
Woodring

(10) Patent No.: US 6,371,191 B1
(45) Date of Patent: Apr. 16, 2002

(54) DECORATIVE VENETIAN BLINDS

(76) Inventor: Cooper C. Woodring, 45 Randolph Sq. SW., Topeka, KS (US) 66611-2045

( * ) Notice: Subject to any disclaimer, the term of this patent is extended or adjusted under 35 U.S.C. 154(b) by 0 days.

(21) Appl. No.: 09/765,512

(22) Filed: Jan. 19, 2001

(51) Int. Cl.[7] ..... E06B 9/38
(52) U.S. Cl. ..... 160/168.1 R; 160/236
(58) Field of Search ..... 160/236, 173 R, 160/178.1 R, 168.1 R; 49/92.1

(56) References Cited

U.S. PATENT DOCUMENTS

| | | | | | |
|---|---|---|---|---|---|
| 2,146,816 | A | * | 2/1939 | Grassby | 160/236 |
| 2,209,355 | A | * | 7/1940 | Schmitz | 160/236 |
| 2,567,256 | A | | 9/1951 | Toti et al. | |
| 2,603,286 | A | * | 7/1952 | Miao | 160/236 |
| 3,490,515 | A | * | 1/1970 | Kandel | 160/236 |
| 4,818,590 | A | * | 4/1989 | Prince et al. | 160/236 X |
| 5,409,050 | A | * | 4/1995 | Hong | 160/236 X |
| 5,419,385 | A | * | 5/1995 | Vogel et al. | 160/121.1 |
| D361,009 | S | | 8/1995 | Potts | |
| D362,978 | S | | 10/1995 | Potts | |
| D363,386 | S | | 10/1995 | Potts | |
| D363,387 | S | | 10/1995 | Potts | |
| D369,265 | S | | 4/1996 | Potts | |
| 5,657,806 | A | * | 8/1997 | Hung | 160/236 X |
| D401,097 | S | | 11/1998 | Litecki | |
| D401,098 | S | | 11/1998 | Litecki | |
| D407,935 | S | | 4/1999 | Spektor | |
| D407,936 | S | | 4/1999 | Spektor | |

FOREIGN PATENT DOCUMENTS

| | | | |
|---|---|---|---|
| EP | 0 409 486 A1 | * | 1/1991 |
| JP | 2000-226972 | * | 8/2000 |

* cited by examiner

*Primary Examiner*—David M. Purol
(74) *Attorney, Agent, or Firm*—SAIDMAN DesignLaw Group

(57) ABSTRACT

A Venetian, horizontal or mini-blind that incorporates a decorative edge treatment for the interior-facing long edge of the blind's slats. The exterior-facing long edge of the blind's slat remains straight, such that the exterior appearance is unchanged.

16 Claims, 4 Drawing Sheets

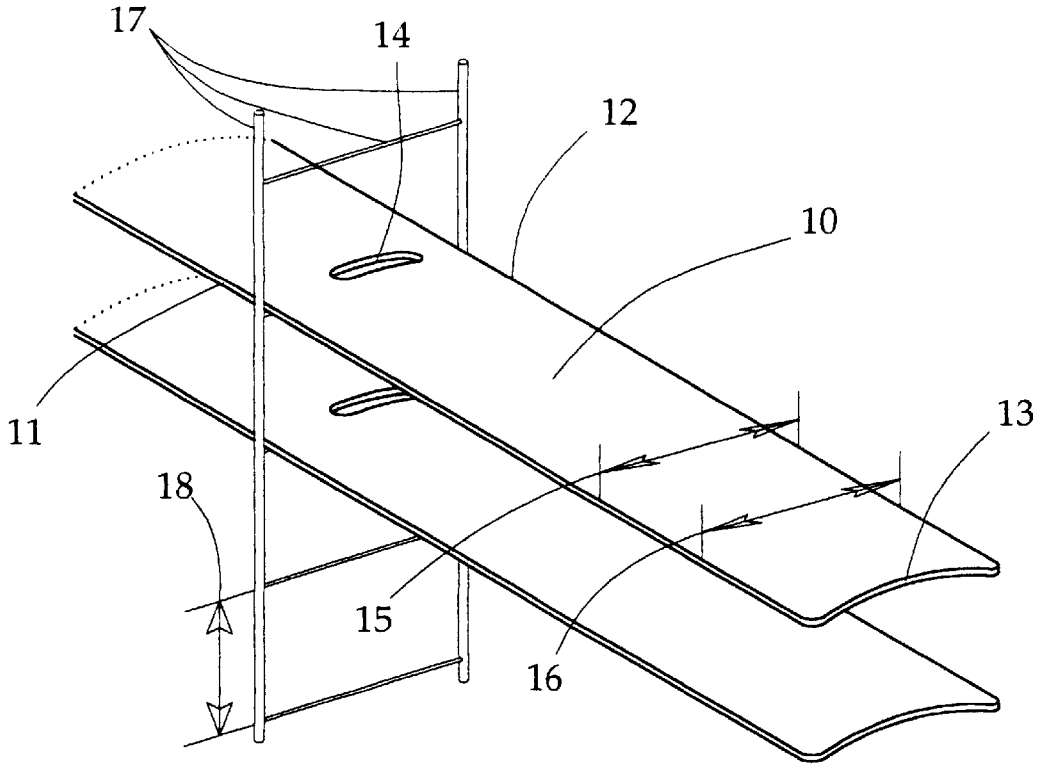
FIG. 1, PRIOR ART
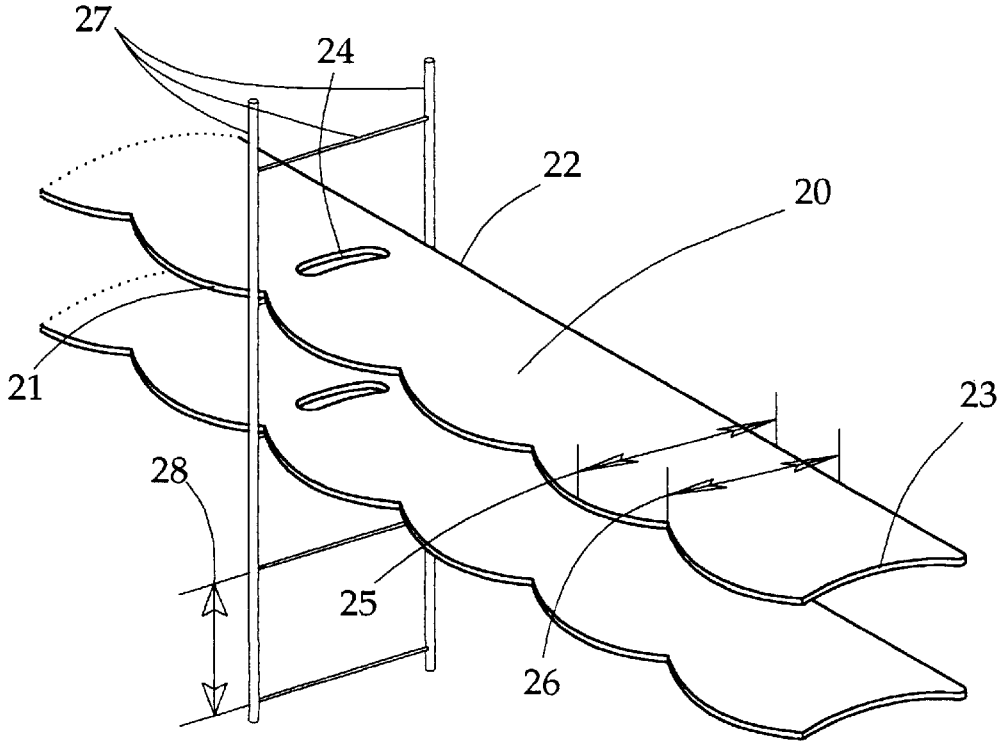
FIG. 2

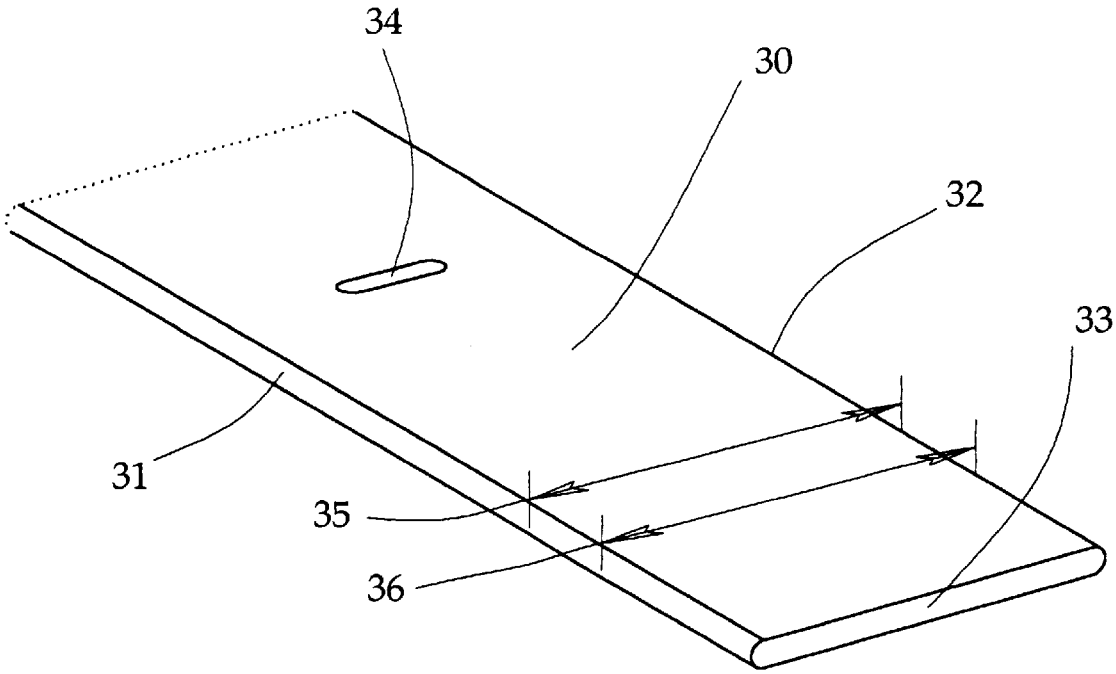
FIG. 5, PRIOR ART
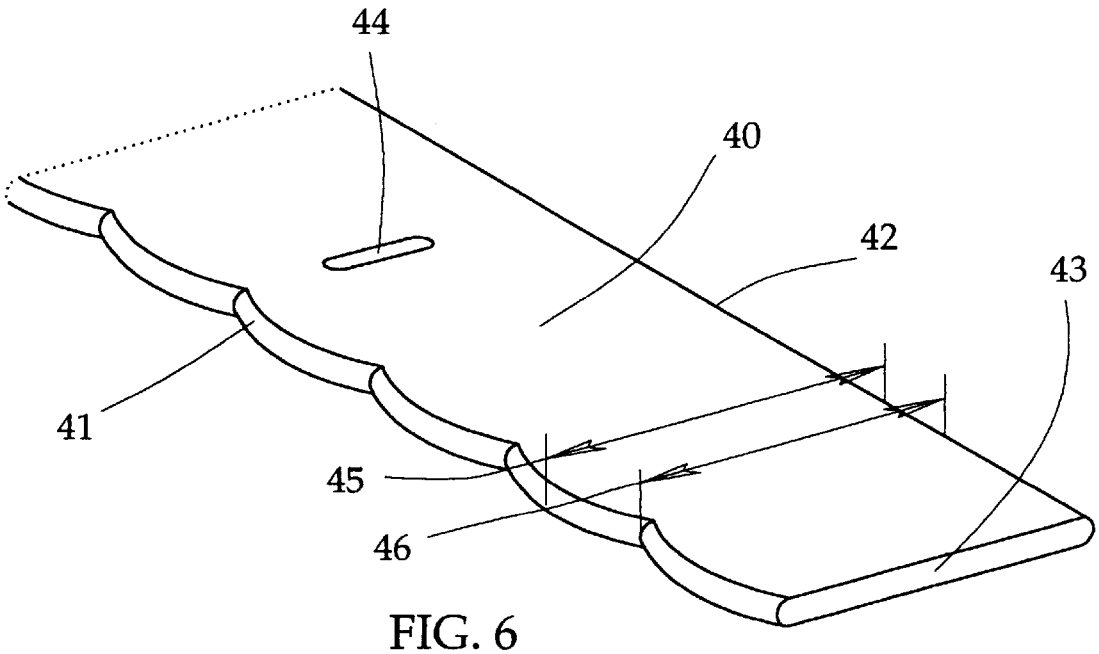
FIG. 6

DECORATIVE VENETIAN BLINDS

FIELD OF THE INVENTION

This invention relates to Venetian blinds, and, more particularly, to a unique slat design that may be used in a Venetian, horizontal or mini blind.

BACKGROUND OF THE INVENTION

Jalousies, as Venetian blinds are known in France, date back 232 years. The first known drawing of a jalousie was by Roubo, in Paris, in 1769, in a book titled, L Art du menuisier, Plate 29, reproduced in Antiques magazine, February 1948.

Venetian, horizontal, or mini blinds are popular window treatments and can be found in many residential and commercial settings. They are inexpensive, provide privacy and room darkening, are easy to open and close, are easy to install, are relatively durable, have long life-expectancy, are available in in-stock sizes due to more standard window sizes and they provide uniform exterior appearance. A white or off-white one-inch slat width in plastics or aluminum is the largest selling version.

A typical Venetian blind includes a quantity of horizontal slats resting on the rungs of two or more fabric ladders, which are movably suspended from a top-rail, which is mounted at the top of a window frame. The ladders' vertical members tilt by raising one member while simultaneously lowering the other member, causing the rungs and the slats to simultaneously tilt. The typical tilt control is by rotating a tilt-wand or by pulling on either one of two tilt cords, which exit the top-rail. Two or more vertical lift-cords are attached to a bottom-rail, pass through vertically-aligned openings in each slat, enter the top-rail, turn and exit the top-rail through a cord-lock mechanism and terminate in a break-apart tassel or two separate tassels. Pulling the lift-cords raises the bottom-rail, sequentially collecting the slats from the bottom up and compressing the entire array of slats against the top-rail.

Consumer research indicates that the largest selling, in-stock, white or off-white, one-inch width slat, plastics or aluminum version is considered more utilitarian than decorative, more commercial than residential, and consumers express concern that everyone else has the same thing.

SUMMARY OF THE INVENTION

The Venetian blind of this invention includes a decorative or irregular edge treatment for the interior-facing long edge of the slats of the blind. The exterior-facing long edge remains straight; therefore the exterior appearance remains unchanged. The decorative treatment of the interior-facing long edge of the slats allows the blind to remain in the overall mainstream of popularity while becoming more decorative, residential, and exclusive in appearance.

The decorative treatments are applicable to slats made of aluminum, plastics, wood, composition, or other materials. Typically, the amount of material removed from the edge of a slat, creating the decorative edge treatment, is less than the amount of overlap between slats, thereby maintaining similar room darkening and privacy qualities. In some blinds, where the slats' overlap is at a minimum, the ladders' rung spacing may have to be shortened, possibly resulting in one or more additional slats per vertical foot of ladder.

There are numerous decorative edge treatments that are contemplated by the present invention. The different decorative treatments allow exclusivity for different channels of distribution, thereby offering a retailer greater exclusivity.

When the slat is in the full open-to-view position, the decorative edge treatment is barely noticeable due to the very thin material of most slats. In the full closed-to-view position, the decorative edge treatment is quite noticeable, especially during daytime as the light filtering between the slats accentuates the visually decorative treatment of the slats decorative interior-facing long edges.

One method of manufacture is a matched set of roller dies to, for example, scallop the one interior-facing long edge of an aluminum slat, similar to the matched set of roller dies currently utilized to crown the aluminum slat material just prior to cutting the slats to the desired length. For extruded plastics slats, a similar roller or stamping die can be utilized. For thermoformed plastics slats, a similar roller or stamping die can also be utilized. For wood or composition slats, a stamping or routing process may be preferable.

DESCRIPTION OF THE RELATED ART

Toti et al., U.S. Pat. No. 2,567,256 discloses a Venetian blind having undulating or festooned slats. Nowhere do Toti et al. teach a slat having a straight long edge and an irregular long edge.

Potts has a series of design patents (U.S. Pat. Nos. Des. 361,009, 362,978, 363,386, 363,387, and 369,285) each of which discloses a vertical louver having both long edges irregular. Nowhere does Potts teach a slat having a straight long edge and an irregular long edge.

Litecki, U.S. Pat. Nos. Des. 401,097 and 401,098, discloses a blind with predominating slats having both long edges irregular. Although Litecki appears to teach a single slat having a straight long exterior-facing edge and an irregular long interior-facing edge (i.e., the top slat), it is for the purpose of allowing the slat to better fit adjacent the blind's header, and is thus limited to one slat only.

Spektor, U.S. Pat. Nos. Des. 407,935 and 407,936, discloses vertical louvers having both long edges irregular. Nowhere does Spektor teach a slat having a straight long edge and an irregular long edge.

BRIEF DESCRIPTION OF THE DRAWINGS

The foregoing and other objects, aspects, uses and advantages of the present invention will be more fully appreciated as the same becomes better understood from the following detailed description of the present invention when viewed in conjunction with the accompanying drawings, in which:

FIG. 1 is a trimetric view of a typical prior art aluminum or plastics slat;

FIG. 2 is a similar trimetric view of an aluminum or plastic slat in accordance with a preferred embodiment of the present invention;

FIG. 5 is a trimetric view of a typical prior art wood or composition slat;

FIG. 6 is a similar trimetric view of a wood or composition slat in accordance with another preferred embodiment of the present invention;

DETAILED DESCRIPTION OF THE PREFERRED EMBODIMENTS

Figure 4:
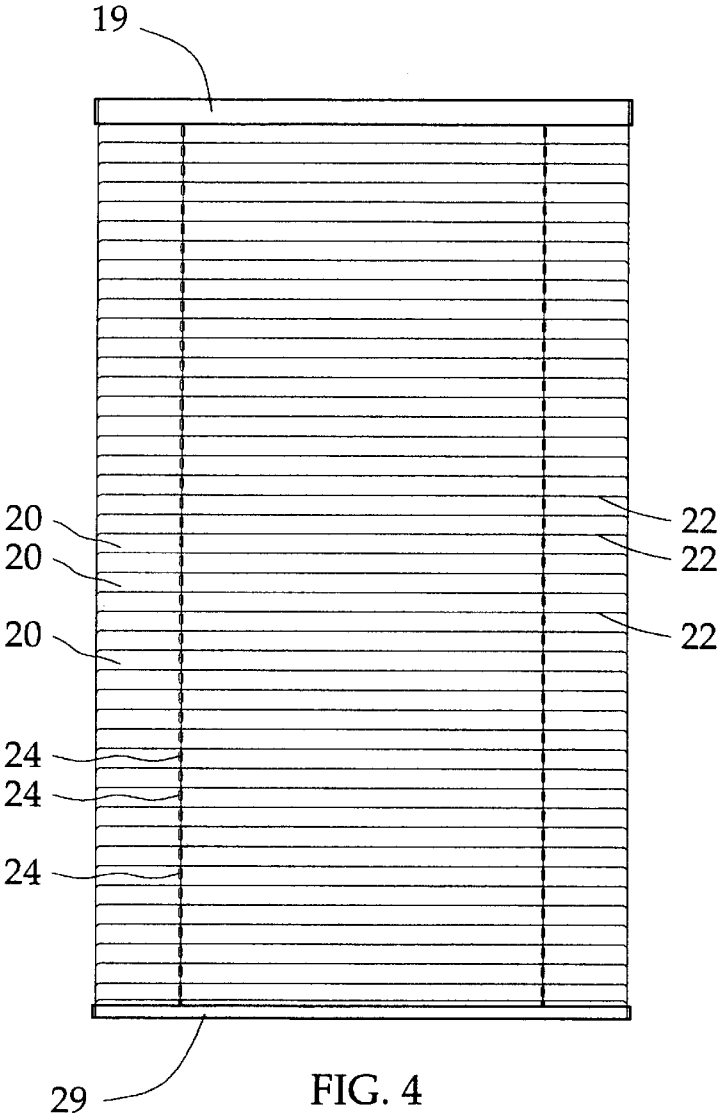
FIG. 4 is a rear view of the preferred embodiment of the present invention shown in FIG. 3.

Referring now to the drawings, wherein like reference numerals represent identical or corresponding parts throughout the several views, FIG. 1 shows a typical prior art aluminum or plastics slat used in a Venetian, horizontal or mini blind (collectively referred to hereafter as Venetian blind). The slat has a body 10, an interior-facing long straight edge 11, an exterior-facing long straight edge 12, an end 13, and an elongated lift-cord opening 14. As is conventional in a Venetian blind, a plurality of such slats is supported on a pair of spaced-apart ladders 17 (only one of which is illustrated in FIG. 1). Each of the ladders 17 includes a pair of vertical supports coupled by spaced horizontal supports or rungs.

The typical slat's cross-section has a slight crown, as can be seen at the end 13, to stiffen its length and prevent the slat from sagging when supported on the ladders 17 that may be spaced 20 inches or more apart. The slat has a maximum slat width 15 and a minimum slat width 16, which are the same. Both the maximum slat width 15 and the minimum slat width 16 are greater than the ladder's rung spacing 18 to cause an upper slat's interior-facing long straight edge 11 to overlap a lower slat's exterior-facing long straight edge 12 when the slat's body 10 is tilted or in the full closed-to-view position to provide room darkening and privacy.

FIG. 2 shows a preferred embodiment of an aluminum or plastic slat for a Venetian blind in accordance with the present invention.

The slat has a body 20, an interior-facing long irregular edge 21, an exterior-facing long straight edge 22, an end 23, and an elongated lift-cord opening 24. The slat's cross-section has a slight crown, as can be seen at the end 23, to stiffen its length and prevent the slat from sagging when supported on ladders 27 that may be spaced 20 inches or more apart. The slat has a maximum slat width 25 and a minimum slat width 26, which are not the same. Both the maximum slat width 25 and the minimum slat width 26 are greater than the ladder's rung spacing 28 to cause an upper slat's interior-facing long irregular edge 21 to overlap a lower slat's exterior-facing long straight edge 22 when the slat's body 20 is tilted or in the full closed-to-view position to provide room darkening and privacy.

FIG. 2 also shows the elongated lift-cord openings 24 aligning with one of the points of minimum width 26 of the slat's body 20 and with the ladder 27. This alignment is to prevent the slat's body 20 from sliding within the ladder 27 when the slat's body 20 is tilted to the full closed-to-view position.

Figure 3:
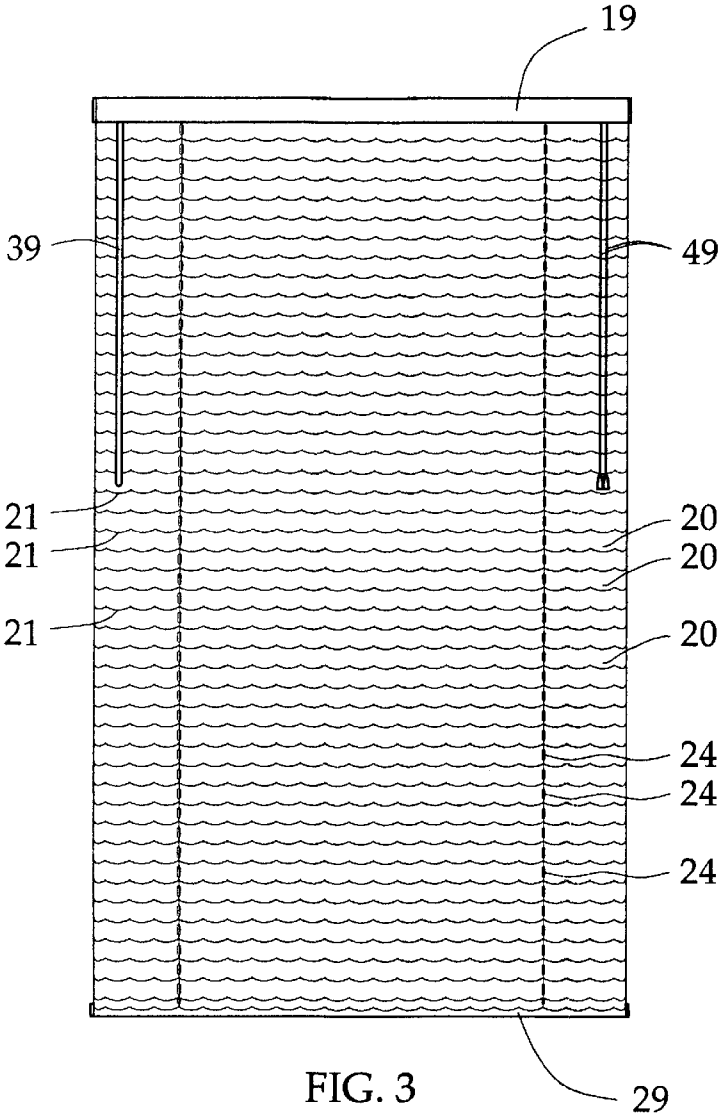
FIG. 3 is a front view of one preferred embodiment of the present invention.

Although only two slats are shown in FIG. 2, it will be appreciated that a greater number (depending on the size of the window) of such slats would be used in a typical Venetian blind, and the present invention contemplates that all such slats within a given Venetian blind are substantially identical to each other. For example, FIG. 3 shows a plurality of slats 20 of the first embodiment of FIG. 2 in their full closed-to-view position (from the interior of the window) wherein the long irregular edges 21 of each slat are visually apparent. As is conventional, the Venetian blind of FIG. 2 includes a header or top rail 19, a bottom rail 29, a tilt wand 39 and lift cords 49, which function in their customary manner. All of the slats 20 in FIG. 3, from the top rail 19 to the bottom rail 29, are identical to one another.

FIG. 4 is a rear, outside view of the embodiment of FIG. 3 in the full closed-to-view position wherein the long straight edges 22 of each slat 20 are apparent.

FIG. 5 shows a typical prior art wood or composition slat. The slat has a body 30, an interior-facing long straight edge 31, an exterior-facing long straight edge 32, an end 33, and an elongated lift-cord opening 34. The slat has a maximum width 35 and a minimum width 36, which are the same.

FIG. 6 shows a preferred embodiment of a wood or composition slat according to the present invention. The slat has a body 40, an interior-facing long irregular edge 41, an exterior-facing long straight edge 42, an end 43, and an elongated lift-cord opening 44. The slat has a maximum width 45 and a minimum width 46, which are not the same. Again, although only one slat is illustrated in FIG. 6, a typical window treatment would require a plurality of substantially identical slats in accordance with the present invention, depending upon the size of the window.

The operation of the wood or composition slat shown in FIG. 5 and FIG. 6 is the same as described for the aluminum or plastic slat shown in FIG. 1 and FIG. 2.

Figure 7:
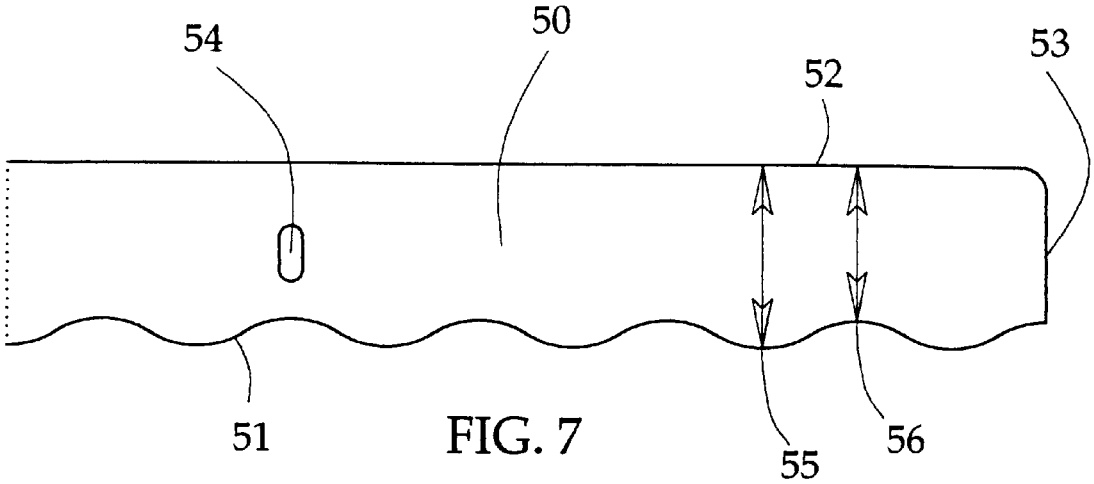
FIG. 7 is top plan view of an alternate decorative edge treatment according to the present invention.

FIG. 7 shows a top plan view of an alternate embodiment of a slat in accordance with the present invention. The slat body 50 has an interior-facing long irregular edge 51, an exterior-facing long straight edge 52, an end 53 and an elongated lift-cord opening 54. The slat has a maximum slat width 55 and a minimum slat width 56, which are not the same.

Figure 8:
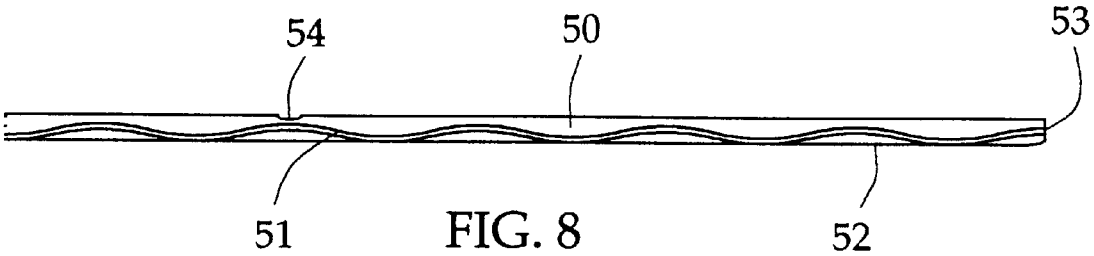
FIG. 8 is a front or interior view of the decorative edge treatment of the embodiment of FIG. 7.

FIG. 8 shows a front view of the same slat shown in FIG. 7. It has a slat body 50, an alternate interior-facing long irregular edge 51, a exterior-facing long straight edge 52, an end 53 and an elongated lift-cord opening 54.

Figure 9:
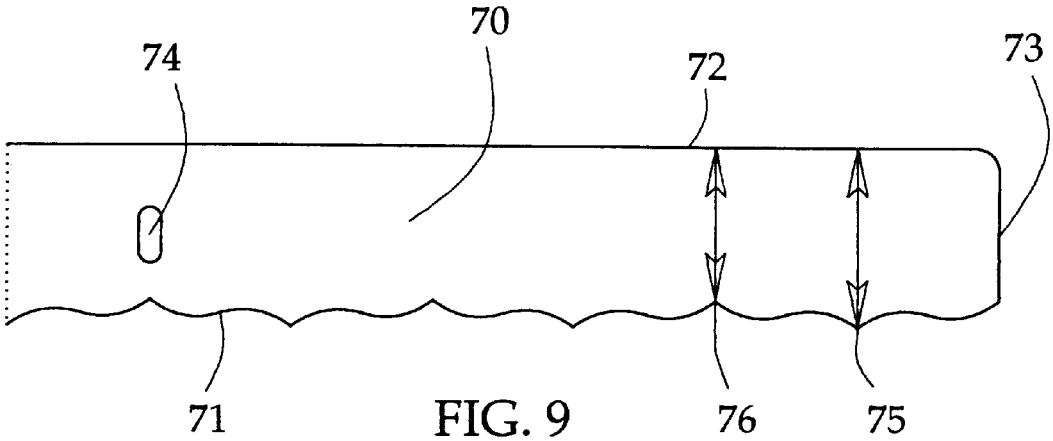
FIG. 9 is top plan view of another alternate decorative edge treatment in accordance with the present invention.

FIG. 9 shows a top plan view of another alternate embodiment of a slat that may be used with the present invention. The slat body 70 has an interior-facing long irregular edge 71, a exterior-facing long straight edge 72, an end 73 and an elongated lift-cord opening 74. The slat has a maximum slat width 75 and a minimum slat width 76, which are not the same.

Figure 10:
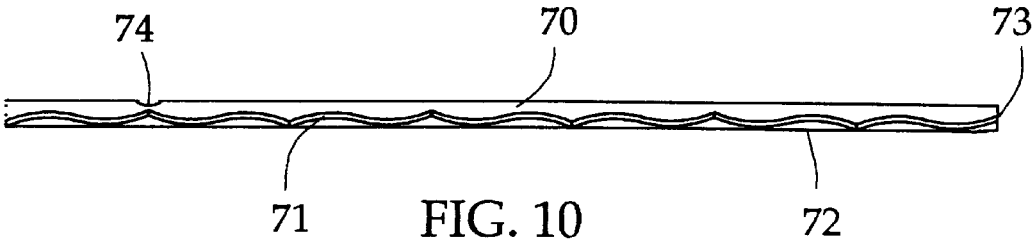
FIG. 10 is a front or interior view of the decorative edge treatment of the embodiment of FIG. 9.

FIG. 10 shows a front view of the same slat shown in FIG. 9. It has a slat body 70, an alternate interior-facing long irregular edge 71, a exterior-facing long straight edge 72, an end 73 and an elongated lift-cord opening 74.

As may be appreciated from the foregoing, in the preferred embodiments of the present invention, I have found that the minimum width should not be less than about two-thirds of the maximum width. Stated another way, the maximum depth of penetration of the "valleys" into the slat should not exceed about 33% of the maximum width of the slat.

From the embodiments disclosed above, it may be appreciated that the irregular edge of the present invention may take any of a number of different aesthetically pleasing shapes. In the embodiments presented, the irregular edges extend along the length of the slat in a periodically changing manner. More particularly, each of the embodiments includes a generally somewhat sinusoidal curve along the length of the slat. In FIG. 7, both the peaks and valleys of the sinusoidal curve are smooth, while in FIGS. 2 and 6, the peaks are smooth and the valleys are pointed. In the embodiment of FIG. 9, both the peaks and valleys of the edge are pointed.

Additionally, the interior-facing long irregular edge may have the decorative motifs or elements spaced at uneven increments, or the interior-facing irregular edge may contain segments of a straight edge between the decorative motifs or elements, or both.

Obviously, numerous modifications and variations are possible in light of the above teachings. Thus, it is to be understood that the above descriptions are illustrative only and various modifications may be made within the scope of the appended claims.

I claim as my invention:

1. A Venetian blind for covering a window of a room having an interior and an exterior, said blind adjustable between a full open-to-view position to a full closed-to-view position and comprising a top rail, a bottom rail, a pair of ladders extending between said top rail and said bottom rail, each of said ladders having a plurality of rungs, adjacent rungs being separated by a rung spacing, and a plurality of horizontal slats extending from said top rail to said bottom rail and resting horizontally on said rungs of said ladders, means connected to said top rail and said bottom rail for tilting, raising and lowering said ladders whereby said plurality of slats may be tilted, raised and lowered, each of said slats having a single interior-facing long irregular edge extending along the length of said slat, and a single exterior-facing long substantially straight edge extending along the length of said slat, said plurality of slats being substantially identical to one another, said slats including at least one point of minimum width along the length thereof, said rung spacing being less than said point of minimum width whereby said slats overlap each other in said full closed-to-view position so as to ensure room-darkening and privacy.

2. The Venetian blind of claim 1, wherein said pair of ladders do not contain any slat that is not substantially identical to every other slat in said blind.

3. The Venetian blind of claim 1, wherein said long irregular edges of said slats are normally only visible in said interior of said room, while said long straight edges of said slats are normally only visible in said exterior of said room.

4. The Venetian blind of claim 1, wherein no slats other than said identical slats are located in said ladders.

5. The Venetian blind as set forth in claim 1, wherein each of said slats include first positions located at the points of minimum width of said slat along said length thereof and second positions located at the points of maximum width of said slat along said length thereof, said minimum and maximum widths not being equal to each other.

6. The Venetian blind as set forth in claim 1, wherein said irregular edge is periodically repetitive along the length of said slat.

7. The Venetian blind as set forth in claim 6, wherein said irregular edge forms a generally sinusoidal curve.

8. The Venetian blind as set forth in claim 7, wherein said sinusoidal curve includes smooth peaks and valleys.

9. The Venetian blind as set forth in claim 7, wherein said sinusoidal curve includes smooth peaks and pointed valleys.

10. The Venetian blind as set forth in claim 7, wherein said sinusoidal curve includes pointed peaks and pointed valleys.

11. The Venetian blind as set forth in claim 5, wherein each of said slats further includes at least one opening formed therein for receiving a lift cord therethrough.

12. The Venetian blind as set forth in claim 11, wherein said at least one opening of each of said slats is aligned with at least one of said first positions.

13. The Venetian blind as set forth in claim 12, further comprising a second opening formed in each of said slats for receiving a second lift cord therethrough.

14. The Venetian blind as set forth in claim 13, wherein said second openings are aligned with another of said first positions.

15. The Venetian blind as set forth in claim 1, wherein said slats each comprise aluminum, plastics, wood or composition material.

16. The Venetian blind as set forth in claim 5, wherein said minimum width is not less than about 67% of said maximum width.

* * * * *